United States Patent [19]

Zilske et al.

[11] 4,391,679

[45] Jul. 5, 1983

[54] ELECTROLYTIC BATH AND PROCESS FOR THE DEPOSITION OF GOLD ALLOY COATINGS

[75] Inventors: Wolfgang Zilske; Werner Kuhn, both of Hanau, Fed. Rep. of Germany

[73] Assignee: Degussa Aktiengesellschaft, Frankfurt, Fed. Rep. of Germany

[21] Appl. No.: 250,142

[22] Filed: Apr. 2, 1981

[30] Foreign Application Priority Data

Apr. 3, 1980 [DE] Fed. Rep. of Germany ..... 3012999

[51] Int. Cl.[3] ..... C25D 3/62

[52] U.S. Cl. ..... 204/43 G

[58] Field of Search ..... 204/43 G, 46 G

[56] References Cited

U.S. PATENT DOCUMENTS

| | | | |
|---|---|---|---|
| 2,978,390 | 4/1961 | Atwater et al. | 204/46 G |
| 3,598,706 | 8/1971 | Freedman et al. | 204/46 G |
| 3,883,409 | 5/1975 | Olivier | 204/44 |
| 3,989,800 | 11/1976 | Gansinger | 204/43 G X |
| 4,013,523 | 3/1977 | Stevens et al. | 204/43 G |
| 4,073,700 | 2/1978 | Weisberg et al. | 204/43 G |
| 4,168,214 | 9/1979 | Fletcher et al. | 204/43 G |

FOREIGN PATENT DOCUMENTS

| | | | |
|---|---|---|---|
| 1262723 | 3/1968 | Fed. Rep. of Germany | 204/43 G |
| 2658003 | 7/1977 | Fed. Rep. of Germany | 204/43 G |

*Primary Examiner*—G. L. Kaplan

*Attorney, Agent, or Firm*—Cushman, Darby & Cushman

[57] ABSTRACT

In the electro industry, there are needed acid gold alloy baths which give glossy, ductile coatings, operate at high current densities, and contain little non-metallic impurities. This is attained by a bath based on potassium cyanoaurate (III) and an acid whereby the bath contains at least one of the alloying metals cobalt, nickel, indium, tin, zinc, or cadmium in the form of a water soluble salt, together with an amine, an aminocarboxylic acid, or a phosphonic acid and has a pH of below 3.

20 Claims, No Drawings

ELECTROLYTIC BATH AND PROCESS FOR THE DEPOSITION OF GOLD ALLOY COATINGS

BACKGROUND OF THE INVENTION

The invention is directed to a gold bath for the electrolytic (galvanic) deposition of high gloss and ductile gold alloy coatings based on potassium cyanoaurate (III) and an acid. In the electro industry today the predominant part of gold coatings are deposited from weakly acid electrolytes which operate in the pH range of 3.5–5. They contain the gold in the form of potassium dicyanoaurate (I), $KA\mu(CN)_2$ and as buffer, salts of weak inorganic or organic acids such as phosphates, citrates, or phosphonates. By the addition of metal salts, above all salts of nickel, cobalt, indium, the properties of the deposited layer are strongly influenced. There are obtained from these baths under conditions in which 0.2–0.5% Ni or Co are codeposited, coatings which are glossy, have a hardness of 150–180 HV, and a good resistance to mechanical abrasion. Beginning with a thickness of about 5μ these coatings are practically pore-free. They are distinguished by good electrical conductivity and low contact resistance.

The coatings from these baths of course also have considerable disadvantages. Their ductility is low. With light mechanical deformation they form cracks. They contain a relatively large (about 1%) amount of non-metallic impurities which probably lead to functional disturbances in contacts for electronic connectors. Probably also because of these impurities, the contact resistance does not remain constant by heating and damages the function of the electrical apparatus.

The content of the alloying metal in the coating is strongly dependent on the current density and the pH so that the working conditions must be held within narrow limits in order to maintain coatings with constant quality. The average current density is limited to about 1 $A/dm^2$. The bath temperature must not be higher than 40° C. and in most baths the pH must be held between 3.5 and 4. At a pH of 4, the coatings are frequently only milky-glossy or already matte. Operation at pH values below 3.5 cannot be used since the $KAu(CN)_2$ decomposes with separation of gold cyanide, AuCN. In spite of this there were attempts to use such baths at pH below 3 (e.g. German AS No. 1262723 and Atwater U.S. Pat. No. 2,978,390), the results, however, were not satisfactory.

It was also tried to operate with baths in the acid range which contain the complex of trivalent gold with potassium cyanide, the potassium tetracyanoaurate (III), $KAu(CN)_4$.

In Freedman U.S. Pat. No. 3,598,706, there is described a process for the production of the tetracyanogold (III) acid, and a bath based thereon. In Fletcher U.S. Pat. No. 4,168,214 there is described a bath for plating a gold strike on stainless steel whereby the tetracyanogold (III) complex is formed by reaction of gold (III) chloride with potassium cyanide in the bath and there is established a pH between 0.1 and 1.5.

These known baths can also contain additional alloying metals. A pure alloy bath for the deposition of gold-tin-coatings based on $KAu(CN)_4$ in hydrochloric acid medium is claimed in German OS No. 2658003. (U.S. Pat. No. 4,013,523).

Baths in which the gold is present in trivalent form in contrast to the baths based on monovalent gold salts have the disadvantage that because of the difference in valence at equal current densities and times only one-third the amount of gold is deposited. This disadvantage can only be balanced by the use of correspondingly higher current densities. However, this is not possible with previously known baths since then the deposited layers are matte and rough so that thick coatings are not economically producible. A further substantial disadvantage is the high chloride content in these baths through which an implement development of chlorine occurs at the anode. If the baths additionally contain hydrochloric acid then there occurs besides corrosion problems on the plant.

Therefore it was the problem of the present invention to find a gold bath for the electrolytic (galvanic) deposition of gold alloy coatings (i.e. gold alloy platings) based on potassium cyanoaurate (III) and an acid which are both high gloss and ductile even at high current densities and in which no chlorine development occurs.

SUMMARY OF THE INVENTION

This problem was solved according to the invention by providing that the bath contains at least one of the alloying elements cobalt, nickel, indium, tin, zinc or cadmium in the form of a water soluble salt together with an amine (e.g. aliphatic amines such as trialkylamines, and polyalkylene polyamines, an aminocarboxylic acid or a phosphonic acid and has a pH of less than 3. Especially advantageous is a pH range of 0.4 to 2.5.

Illustrative salts are cobalt sulfate, indium citrate, zinc sulfate, cadmium sulfate, nickel sulfate, zinc sulfate, and tin (II) sulfate.

There have proven good baths which contain 1–20 g/l of gold in the form of potassium cyanoaurate (III), 10–200 g/l of sulfuric acid, phosphoric acid and/or citric acid, 0.1–20 g/l of at least one of the alloying metals cobalt, nickel, indium, zinc, tin or cadmium in the form of a water soluble salt and 1–100 g/l of an amine, an aminocarboxylic acid or a phosphonic acid which is capable of forming a complex with the alloying metal. Besides the addition of salts of the acids used as for example potassium dihydrogen phosphate, potassium hydrogen sulfate, sodium hydrogen sulfate, potassium citrate or sodium citrate is advantageous. Preferably the process is operated at a temperature of 40° to 60° C. and a current density of 0.1–20 $A/dm^2$ although the temperature and current density can vary outside the indicated ranges.

It has suprisingly been found that glossy gold layers can be deposited over a wide range of current densities from acid electrolytes based on the tetracyanoaurate (III) complexes if the baths contain alloying metals and simultaneously suitable complex formers. The alloying metals can be Co, Ni, In, Sn, Zn, or Cd. Suitable complex formers are amines (e.g. unsubstituted amines), aminocarboxylic acids or phosphonic acid. If the alloying metal is added only in the form of simple salts, as in the previously known baths, then the metal distribution in the coating is non-uniform, since generally the amount of codepositing alloying metal is strongly dependent on the current density. Surprisingly it has now been proven that in using the mentioned complex formers, the codeposition is practically independent of the current density so that with optimal selection of gold content, pH and bath temperature, the coating has a constant alloying metal content. In other known baths this independence generally is not given.

Through this there is possible the use of higher current densities and therefore deposition rates can be attained such as are customary with the known weakly acid gold baths in the pH range between 3.5 and 5.

The use of the mentioned complex formers in electrolytic baths is known of itself but it was not to be expected that these materials so strongly controlled the codeposition of the alloying elements under the stated conditions since the stability of the complexes with the mentioned metals normally is low at pH value below 3.

The properties of the deposited coatings from the bath of the invention are particularly advantageous in comparison to the coatings from the so-called weakly acid gold baths. The coatings not only are hard and resistant to wear but also are very ductile. Already in thin coatings they can be deposited with low porosity. The contact resistance is low and remains constant even after heating. The content of non-metallic impurities is very low.

Baths according to the invention contain:

1–20 g/l of gold as $KAu(CN)_4$,

10–200 g/l of phosporic acid, sulfuric acid or mixture thereof, citric acid, phosphates, e.g. monopotassium phosphate or potassium sulfate.

0.1–20 g/l of an alloying metal which can be Co, Ni, In, Sn, Zn or Cd

1–100 g/l of an amine (i.e. an unsubstituted amine, e.g. a trialkylamine), an aminocarboxylic acid or a phosphonic acid.

The $KAu(CN)_4$ can be produced in known manner by reaction of $A\mu Cl_3$ with KCN and crystallized from the mother liquor. Thereby there is obtained a salt which only contains a little chloride. The amount of acid contained in the bath is not critical. At higher contents of acid there is attained a better conductivity. A portion of the phosphoric acid can also be added as $KH_2PO_4$, if too low a pH is attained by the acid alone.

As suitable complex formers (complexing agents or chelating agents) there are set forth below an illustrative series of compounds including ethylenediamine, tetraethylenepentamine, triethylenetetramine, triethylamine, diethylenetriamine, nitrilotriacetic acid and its sodium and potassium salts, ethylenediaminetetraacetic acid and its sodium and potassium salts, 1,2-diaminocyclohexanetetraacetic acid and its sodium and potassium salts, bis-2-aminoethylethertetraacetic acid and its sodium and potassium salts, diethylenetriaminepentaacetic acid and its sodium and potassium salts, 1-hydroxyethane-1,2-disphosphonic acid and its sodium and potassium salts, aminotrimethylenephosphonic acid and its sodium and potassium salts, ethylenediaminetetramethylphosphonic acid and its sodium and potassium salts, hexamethylene diamino tetra-(methyl phosphonic acid) and its sodium and potassium salts.

As phosphonic acids there can be used any of those disclosed in Olivier U.S. Pat. No. 3,883,409. The entire disclosure of Olivier and German OS No. 2,042,127 referred to therein are hereby incorporated by reference and relied upon.

The bath of the invention is advantageously used in the pH range of 0.4 to 2.5. Both substantially lower and also substantially higher pH values lead to the decomposition of the gold complex with deposition of insoluble gold (I) cyanide. Preferably the bath is operated at a pH between 0.6 and 2.0. The bath can be used at room temperature (e.g. 20° C.) but higher temperatures up to 60° C. are advantageous for increasing the deposition rate. The usable range of current density is extraordinarily broad. There are produced glossy coatings above all at current densities from 0.2 to at least 10 $A/dm^2$.

The composition can comprise, consist essentially of consist of the stated materials.

Unless otherwise indicated all parts and percentages are by weight.

The following examples further explain the advantages of the bath of the invention.

EXAMPLE 1

A bath was produced by dissolving the following components.

75 grams of 85% phosphoric acid were diluted in 500 ml of distilled water. Then there was added 50 ml of a cobalt complex solution and 3.5 grams of $KAu(CN)_4$ dissolved in water. The bath was filled with water to about 900 ml, the pH adjusted with aqueous potassium hydroxide to 1.5 and finally made up with water to 1 liter. The bath was heated to 25° C. A light yellow, glossy gold coating having a thickness of 1.2μ was deposited on a sheet copper cathode at a current density of 2 $A/dm^2$ in 20 minutes.

Then the gold content was increased to 8 g/l, the bath heated to 50° C. and the deposition repeated at a current density of 8 $A/dm^2$. Then there were deposited 3μ thickness of gold in 10 minutes. The coating likewise is light yellow and glossy. In both coatings, there was detected about 0.5% of cobalt. The copper underlayer was dissolved from the second sample with 3:1 diluted nitric acid. There was obtained a ductile gold film which did not break even with sharp bending. The cobalt complex solution used as an additive in the bath was produced as follows: 47.8 grams of $CoSO_4$, corresponding to 10 grams of Co were dissolved in about 600 ml of water with heating, 222 ml of 1-hydroxyethane-1,1-diphosphonic acid (60%) added and filled up to 1 liter.

EXAMPLE 2

In accordance with Example 1, there was produced a bath from the following components:

26.3 ml $H_3PO_4$ (85%);

13.6 ml $H_2SO_4$ (96%);

50 ml cobalt complex solution (as in Example 1).

The bath was again filled to 1 liter. There were added 1.73 grams of K $Au(CN)_4$ (1 gram Au) and the pH adjusted to 0.6 with sulfuric acid.

A solid gold coating of 0.2μ was deposited on a cathode of 18 Cr 8 Ni steel in 5 minutes at a current density of 2 $A/dm^2$.

EXAMPLE 3

A liter bath was produced by dissolving the following components in water:

25 grams $KH_2PO_4$, 60 grams $H_3PO_4$ (85%), 4.2 grams $NiSO_4.7H_2O$, 13.8 grams $KAu(CN)_4$ (8 g/l Aμ), 10 grams ethylenediamine.

The pH was adjusted to 2.0 and the bath heated to 40° C. At a current density of 5 $A/dm^2$, there was desposited in 10 minutes a 2.5μ thick glossy gold coating on a copper sheet. There is contained in the gold 0.4% Ni.

EXAMPLE 4

There were carried out depositions from a bath containing the following components:

90 g/l $H_3PO_4$ (85%), 10 g/l $H_2SO_4$ (96%)
6 g/l $In_2(SO_4)_3.5H_2O$,
8.6 g/l $KAu(CN)_4$ (5 g/l Au),
9 g/l ethylenediaminetetraacetic acid.

The pH of the bath was adjusted to 1.8. At a current density of 9 A/dm$^2$ and 50° C. bath temperature, in 10 minutes there was deposited on a nickel plated coppeer sheet a glossy, light yellow gold coating having a thickness of 2$\mu$.

The entire disclosure of German priority application No. P 3012999.8 is hereby incorporated by reference.

What is claimed is:

1. A gold bath suitable for the deposition of high gloss and ductile gold alloy coatings consisting of either (1) water, potassium cyanoaurate (III), at least one alloying element selected from the group consisting of cobalt, nickel, indium, zinc, and cadmium in the form of a water soluble salt together with a hydrocarbyl amine, an aminocarboxylic acid, or a phosphonic acid which forms a complex with the alloying element and 20–200 g/l of sulfuric acid, phosphoric acid, citric acid or a mixture thereof, or (2) the gold bath (1) together with potassium dihydrogen phosphate, potassium hydrogen sulfate or potassium citrate, said bath having a pH of less than 3.

2. A gold bath according to claim 1 wherein the bath has a pH between 0.4 and 2.5.

3. A gold bath according to claim 2 wherein the pH is between 0.6 and 2.0.

4. A gold bath according to claim 2 wherein the bath contains 1–20 g/l of gold in the form of potassium cyanoaurate (III).

5. A gold bath according to claim 4 which contains potassium dihydrogen phosphate, potassium hydrogen sulfate, or potassium citrate.

6. A gold bath according to claim 5, including 0.1–20 g/l of the alloying element in the form of a water soluble salt.

7. A gold bath according to claim 6, including 1–100 g/l of the amine, aminocarboxylic acid, or phosphonic acid.

8. A gold bath according to claim 4, including 0.1–20 g/l of the alloying element in the form of a water soluble salt.

9. A gold bath according to claim 8, including 1–100 g/l of the amine, aminocarboxylic acid, or phosphonic acid.

10. A gold bath according to claim 1 which is gold bath (1).

11. A gold bath according to claim 1 wherein the alloying element is cobalt.

12. A gold bath according to claim 1 wherein the alloying element is nickel.

13. A gold bath according to claim 1 wherein the alloying element is indium.

14. A process of depositing a high gloss and ductile gold alloy coating on a base metal comprising employing the gold bath of claim 7 with an electric current at a temperature of 40°–60° C.

15. A process according to claim 14 wherein the current density is 0.1–20 A/dm$^2$.

16. A process of depositing a high gloss and ductile gold alloy coating on a base metal comprising employing the gold bath of claim 9 with an electric current at a temperature of 40°–60° C.

17. A process according to claim 16 wherein the current density is 0.1–20 A/dm$^2$.

18. A process of depositing a high gloss and ductile coating on a base metal comprising employing the gold bath of claim 9 with an electric current at a current density of 0.1–20 A/dm$^2$.

19. A process of depositing a high gloss and ductile gold alloy coating on a base metal comprising employing the gold bath of claim 1 with an electric current at a temperature of 40°–60° C.

20. A process according to claim 19 wherein the current density is 0.1–20 A/dm$^2$.

* * * * *